US007887262B2

(12) United States Patent
Åstrand

(10) Patent No.: US 7,887,262 B2
(45) Date of Patent: Feb. 15, 2011

(54) ATTACHMENT

(75) Inventor: Daniel Åstrand, Göteborg (SE)

(73) Assignee: GVA Consultants AB, Gothenburg (SE)

( * ) Notice: Subject to any disclaimer, the term of this patent is extended or adjusted under 35 U.S.C. 154(b) by 82 days.

(21) Appl. No.: 12/123,226

(22) Filed: May 19, 2008

(65) Prior Publication Data

US 2008/0292406 A1 Nov. 27, 2008

(30) Foreign Application Priority Data

May 22, 2007 (SE) ..... 0701218

(51) Int. Cl.
*E02D 5/60* (2006.01)

(52) U.S. Cl. ..... 405/211; 405/216; 114/264

(58) Field of Classification Search ..... 405/211, 405/211.1, 216, 223.1, 227; 114/264, 256, 114/61.1, 61.14
See application file for complete search history.

(56) References Cited

U.S. PATENT DOCUMENTS 4,084,430 A * 4/1978 Boyle et al. ..... 73/862.041
4,143,540 A 3/1979 Peterson et al.
4,771,720 A * 9/1988 Yuzuriha et al. ..... 114/265
4,830,540 A * 5/1989 Abrams ..... 405/216
5,941,662 A * 8/1999 Weaver ..... 405/211.1

FOREIGN PATENT DOCUMENTS

JP 2004-100266 4/2004

* cited by examiner

*Primary Examiner*—Frederick L Lagman
(74) *Attorney, Agent, or Firm*—KBR IP Legal Dept.

(57) ABSTRACT

The present embodiments relate to various attachments for attaching together a first body and a second body of a marine structure, which marine structure is adapted to be located at least partially immersed in water, wherein at least a portion of each one of the first and second bodies is adapted to, during use, be in contact with the water. The attachment comprises at least a portion of the second body and comprises a wall, which delimits the second body. The attachment can further comprise at least a portion of the first body, wherein the first body is fixedly attached to, and extends from, the second body. The can attachment further comprise a sealing member, attached to the wall and the first body, which sealing member extends from the wall to the first body such that an enclosed volume is formed between the sealing member, the first body and the second body.

15 Claims, 6 Drawing Sheets

ATTACHMENT

CROSS REFERENCE TO RELATED APPLICATIONS

This application claims priority to Swedish Patent Application 0701218-0, filed with the Swedish Patent Office on May 22, 2007, the entirety of which is incorporated by reference herein.

BACKGROUND

1. Field

The present embodiments relate to attachments for attaching together a first body and a second body of a marine structure, which marine structure is adapted to be located at least partially immersed in water, wherein at least a portion of each one of the first and second body is adapted to, during use, to be in contact with the water. An attachment can comprise at least a portion of the second body, which comprises a wall which delimits the second body. An attachment can further comprise at least a portion of the first body, wherein the first body is fixedly attached to, and extends from, the second body.

The present embodiments further relate to methods of attaching together a first and second body of a marine structure. Further, the present embodiments relate to a semi-submersible vessel comprising an attachment according to the present invention.

2. Description of the Related Art

Marine structures are generally used for performing work and/or transports at sea or in lakes. For example, marine structures are used for drilling for, and production of, natural recourses such as gas or oil, when the natural recourses for instance are located in a well which is situated below the bottom of an ocean or a lake. Marine structures are also used for quartering personnel working at sea or on a lake.

As an example of marine structures, fixed production platforms may be mentioned, i.e. the type of platform constituted by a framework which is fixedly attached to a sea floor and extends upwardly through the water surface, or floating semi-submersible vessels which comprise a plurality of floats and/or columns. In order to enhance the strength of the marine structure, this is quite often provided with one or more bracings. For example, a semi-submersible vessel which is constituted by two pontoons and four columns may be provided with a bracing extending between the floats and/or the columns in order to make the ship more durable to external loads such as wave loads or internal loads such as for example the dead weight of the ship or pressure from liquids located on the ship.

Traditionally, a bracing is fixedly attached to the outer walls of the parts which are to be joined to one another and the fixed attachment is often achieved by means of a welded joint. Since the outer walls of the parts which are to be joined to one another by the bracing, in the example of a semi-submersible vessel the parts may for instance be pontoons and/or columns, often are adapted to be arranged at least partially immersed in water, often salt water, the weld joints are quite often located in a harsh environment. This makes great demands upon the weld joints and leads to expensive and complicated welding operations in order to achieve weld joints which fulfill the requirements of both extreme and fatigue strength, in particular since the weld joints are adapted to transfer large loads from the bracing to the outer walls. Furthermore, since the weld joints are located beneath the water surface, they may be difficult to inspect and/or repair, which results in that great demands also are made on the working life of the weld joints.

In order to solve this problem, the prior art proposes, for example U.S. Pat. No. 4,771,720, that the bracing is attached to an inner structure of a support column of a semi-submersible vessel. By this solution, a part of the load transfer from the bracing to the column occurs through a weld attachment which is located within the column and which is thus not exposed to the water ambient to the column. U.S. Pat. No. 4,771,720 also discloses that a portion of the bracing is attached to the wall of the column and this attachment is adapted to on the one hand be located in a harsh environment, namely immersed in water, and on the other hand transfer large loads from the bracing to the column. Thus, even if a reduction of the loads which are transferred through the weld attachment located in water is achieved in U.S. Pat. No. 4,771,720, it may still be difficult and expensive to design a weld attachment which is sufficiently strong as regards both extreme and fatigue strength. Furthermore, it is difficult to inspect the weld attachment which is located in water. Moreover, the attachment illustrated in U.S. Pat. No. 4,771,720 is especially suitable for marine structures under construction, or at least an attachment of a new bracing in an existing column.

Thus, a need exists for further improving the attachment of bracings in bodies of marine structures in order to enhance the strength of the joint, in particular as regards the fatigue strength.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
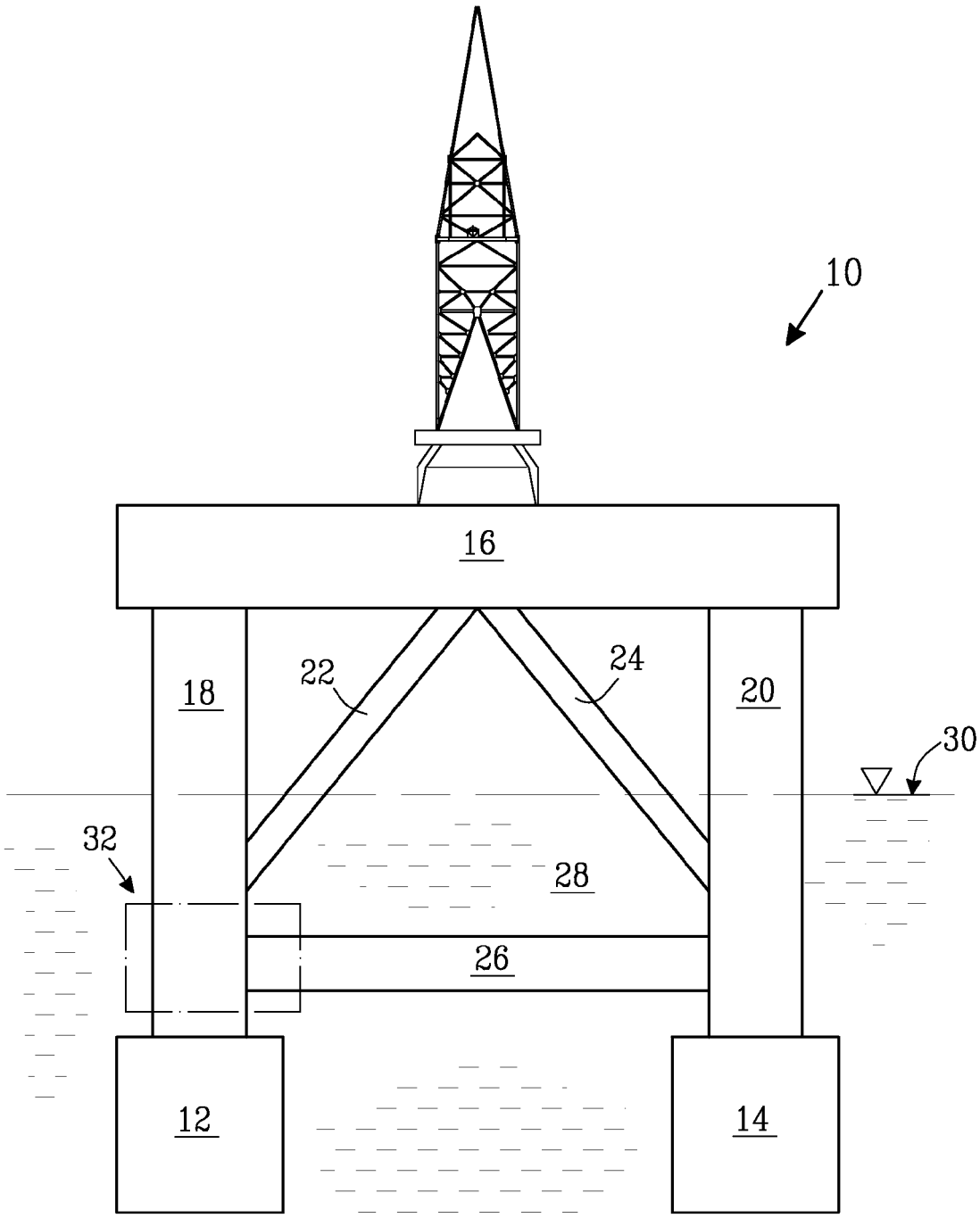
FIG. 1 depicts a front view of a semi-submersible vessel.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

A first object of the present invention is to provide an attachment between a first body to a second body of a marine structure, wherein a load transfer between the first and second bodies mainly occurs through joints which are adapted to not be in contact with the water ambient to the marine structure.

A second object of the present invention is to provide an attachment between a first body and a second body of a marine structure, wherein the joints which are a part of the attachment and which are adapted to be located in water may be designed in a simple and cost efficient way, but nevertheless fulfill requirements on the strength, in particular the fatigue strength.

A third object of the present invention is to provide an attachment between a first body and a second body of a marine structure, wherein a load transfer between the first and second bodies mainly occurs through joints which are located in areas which are easy to inspect.

A fourth object of the present invention is to provide an attachment between a first body and a second body of a marine structure, wherein the attachment may be executed on already existing connections between a first and a second body.

At least one of the objects above is achieved by an attachment according to claim 1.

Thus, the present invention relates to an attachment for attaching together a first body and a second body of a marine structure, which marine structure is adapted to be located at least partially immersed in water, wherein at least a portion of each one of the first and second bodies is adapted to, during use, be in contact with the water, wherein the attachment comprises at least a portion of the second body, wherein the second body comprises a wall which delimits the second body. The attachment further comprises at least a portion of the first body, wherein the first body is fixedly attached to, and extends from, the second body.

According to the present invention, the attachment further comprises a sealing member, attached to the wall and the first body, which sealing member extends from the wall to the first body such that an enclosed volume is formed between the sealing member, the first body and the second body.

By the above joint, the fixed connection between the first body and the second body will be separated from the water surrounding the marine structure. This means that the fixed connection will be located in an environment which is substantially less harsh as compared to the prior art. Further advantages of the sealing member, as compared to the prior art, are that this may be attached around already existing connections between a first and a second body of a marine structure, and that the first body does not necessarily need to be attached within the second body, although this is preferred.

According to a preferred embodiment of the invention, the sealing member is designed such that a displacement imparted on the first body relative to the second body results in a highest mechanical stress in the sealing member which is substantially lower than a highest mechanical stress in the first body, such that only a small part of the loads which are transferred between the first body and the second body is conducted through the sealing member.

Accordingly, the joints which are a part of the attachment which joints are adapted to be located in the water surrounding the marine structure, namely the joints attaching the sealing member to the wall and the first body, will only be exposed to a small portion of the loads transferred between the first and second body. This results in that these joints may be designed in a simple and cost efficient manner and nevertheless present strength characteristics, in particular as regards fatigue strength.

According to a further embodiment of the present invention, the highest mechanical stress in the sealing member is less than half, preferably less than a fourth, more preferably less than a tenth of the highest mechanical stress in the first body.

According to another embodiment of the present invention, the sealing member is fixedly attached to the wall and the first body by means of a welded joint.

According to a further embodiment of the present invention, the sealing member is fixedly attached to the wall along a first closed circuit around the first body, wherein the sealing member further is attached to the first body along a second closed circuit around the first body, wherein the ratio between the circumference of the first closed circuit and the second closed circuit is in the interval of 1.5-5, preferably within the interval of 2-4.

According to another embodiment of the present invention, the sealing member has a first extension from the wall in a direction which is substantially parallel to the extension direction of the first body, wherein the ratio between the length of the first extension of the sealing member and the circumference of the second circuit is within the interval of 0.1-1, preferably within the interval 0.2-0.6.

According to a further embodiment of the present invention, the sealing member comprises a first portion extending substantially parallel to the extension direction of the first body and a second portion extending substantially parallel to the extension direction of the wall.

According to another embodiment of the present invention, the sealing member further comprises a third portion extending substantially parallel to the first portion and a fourth portion, extending substantially parallel to the second portion.

According to a further embodiment of the present invention, the sealing member further comprises a fifth portion extending substantially parallel to the first portion and a sixth portion extending substantially parallel to the second portion, wherein the third and fifth portion are located at substantially the same distance from the wall.

According to another embodiment of the present invention, the second body is buoyant.

As used herein, the expression "buoyant" relates to a body the mass of which is lower than the mass of the volume the body would, when incorporated in the marine structure, displace if the body was to be immersed in water.

According to a further embodiment of the present invention, the wall comprises an opening which is located in the above-mentioned portion of the second body. The opening is located within the sealing member, in order to make inspection of the enclosed volume possible.

According to another embodiment of the present invention, the second body comprises an inner structure which is enclosed by the wall, whereby the first body is fixedly attached to the inner structure and extends out of the opening in the wall.

According to a further embodiment of the present invention, the inner structure comprises a bulkhead and the first body is fixedly attached to the bulkhead.

According to another embodiment of the present invention, the sealing member is constituted by a plate, preferably a plate of the same material as the second body and/or the first body.

According to a further embodiment of the present invention, the first body comprises an outer wall and the ratio between the thickness of the plate and the thickness of the outer wall is within the interval of 0.1-0.6, preferably within the interval of 0.2-0.4.

According to another embodiment of the present invention, the second body is a float of a ship, preferably of a semi-submersible vessel.

According to a further embodiment of the present invention, the first body is a bracing.

A second aspect of the invention relates to a semi-submersible vessel comprising a float, a deck structure and at least one column extending from the float to the deck structure, wherein the ship further comprises an attachment according to the present invention.

According to a preferred embodiment of the second aspect of the invention, the column comprises the attachment.

A third aspect of the invention relates to a method of attaching together a first body and a second body of a marine structure, wherein the second body is buoyant and comprises a wall which delimits the second body. In accordance with the third aspect of the invention, the method comprises the steps of: attaching the first body to the second body such that the first body protrudes from the second body; applying a sealing member extending between the wall and the first body, and attaching the sealing member to the wall and the first body.

According to a preferred embodiment of the third aspect of the invention, the second body comprises an inner structure which is enclosed by the wall, wherein the wall further comprises an opening. The first body is attached to the second body by attaching the first body to the inner structure such that the first body protrudes through the opening.

According to a further embodiment of the third aspect of the invention, the sealing member is attached to the wall and the first body by means of welding.

A fourth aspect of the present invention relates to a use of a sealing member for the method according to the third aspect of the present invention and/or for an attachment according to the first aspect of the present invention.

With reference to the figures, FIG. 1 illustrates a marine structure in the form of a semi-submersible vessel 10. The vessel 10 in FIG. 1 comprises two floats 12, 14 in the form of pontoons, a deck structure 16 and four columns, of which only two 18, 20 are visible in FIG. 1. Each one of the columns 18, 20 extends from a float 12, 14 to the deck structure 16.

The vessel 10 in FIG. 1 further comprises three bracings 22, 24, 26 wherein two of the bracings 22, 24 extend between the deck structure 16 and a column 18, 20 while the third bracing 26 extends between the two pontoons 12, 14. Other variants of the vessel 10 may comprise bracings extending between two columns 18, 20 and/or between a pontoon and a column 20.

As realized from FIG. 1, when the ship floats in water 28 with a still water surface 30, the transition of at least one end of each one of the bracings 22, 24, 26 of the vessel 10 is located in the water 28. Above all for these transitions, but also to some extent for transitions which are adapted to be located above the still water surface 30, an attachment according to the present invention is preferably used.

Figure 2:
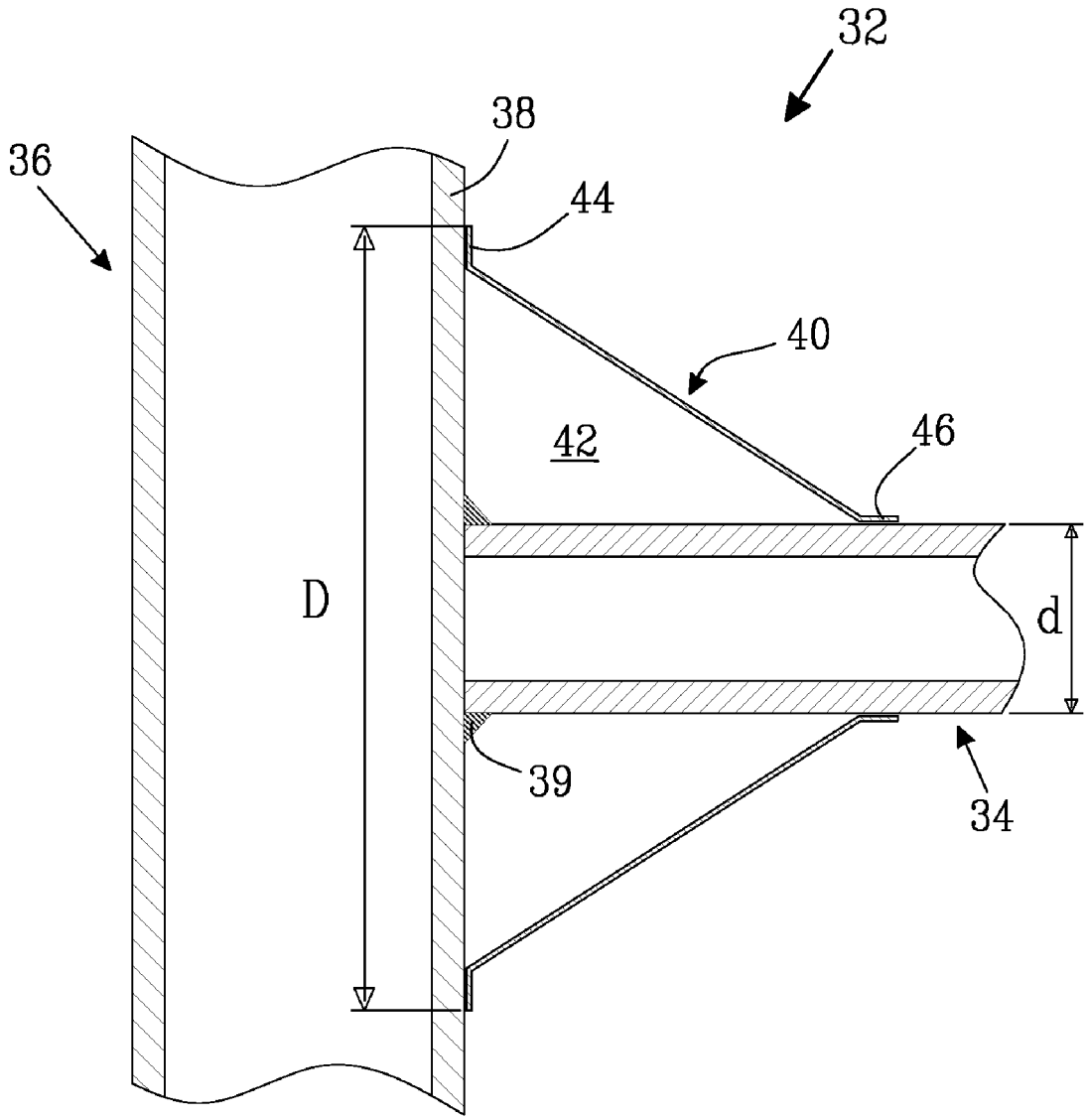
FIG. 2 depicts a cross-section of an embodiment of the attachment.

FIG. 2 illustrates a preferred embodiment of an attachment 32 for attaching together a first body 34 and a second body 36 of a marine structure, which marine structure is adapted to be located at least partially immersed in water, wherein at least a portion of each one of the first 34 and second body 36 is adapted to, during use, to be in contact with the water. The attachment 32 comprises at least a portion of the second body 36, wherein the second body comprises a wall 38 which delimits the second body 36. In the embodiment illustrated in FIG. 2, the second body 36 is a column of a semi-submersible vessel. In the embodiment illustrated in FIG. 2, the second body 36 is thus buoyant, but the invention may also be carried out on two non-buoyant bodies, for example two solid bodies.

The attachment 32 further comprises at least a portion of the first body 34, wherein the first body 34 is fixedly attached to, and extends from, the second body 36. In the embodiment illustrated in FIG. 2, the first body 34 is a hollow bracing which is fixedly attached to the second body by means of a weld joint 39 extending around the circumference of the bracing.

FIG. 2 further illustrates that the attachment 32 comprises a sealing member 40, attached to the wall 38 and the first body 34, which sealing member 40 extends from the wall 38 to the first body 34 such that an enclosed volume 42 is formed between the sealing member 40, the first body 34 and the second body 36. This enclosed volume 42 results in that the weld joint 39 is in a non-harsh environment. In the example illustrated in FIG. 2, this environment could be improved even further by filling the volume 42 with a fluid which protects the weld joint 39 from corrosion, such as oil. This fluid could be replenished through for example one or several openings (not shown) in the sealing member 40 which is sealed before the marine structure, which in this case is the vessel 10, is used at sea.

In order to reduce the stress in the points of attachment between the sealing member 40 and the first 34 and second 36 body, respectively, the sealing member is preferably designed such that a displacement imparted on the first body 34 relative to the second body 36 results in a highest mechanical stress in the sealing member 40 which is substantially lower than a highest mechanical stress in the first body 34, such that only a small part of loads which are transferred between the first body 34 and the second body 36 is conducted through the sealing member 40.

Preferably, the highest mechanical stress in the sealing member 40 is less than half, preferably less than a fourth, more preferably less than a tenth of the highest mechanical stress in the first body 34. This is done in order to further reduce the load transferred through the sealing member 40. This share is continuously reduced, the smaller the highest mechanical stress in the sealing member 40 is as compared to the highest mechanical stress in the first body 34 and in some implementations of the sealing member 40, the highest mechanical stress in the sealing member may be as low as one hundredth of the highest mechanical stress in the first body 34, for a given displacement of the first body 34 relative to the second body.

The displacement of the first body 34 relative to the second body 36 may be of various kinds, for instance the first body may be bent, extended or compressed, depending for instance on the relative motions of the bodies with which the first body 34 is attached.

The difference in the highest mechanical stress between the sealing member 40 and the first body 34 may be achieved in a plurality of ways. Among others, the sealing member 40 may be manufactured from, or at least comprise, a material the modulus of elasticity of which is substantially lower than the material in the first body 34, for example the sealing member 40 may be made of rubber. Optionally, the sealing member 40 may be manufactured of a material having a modulus of elasticity which is approximately the same as the material of the first body 34, the sealing member 40 may even be made of the same material as the material of the first body 34, but the lower bending stiffness of the sealing member is instead obtained by the design of the sealing member 40. FIG.

2 illustrates that the sealing member 40 preferably is fixedly attached to the first body 34 by means of weld joints 44, 46 even though other attachment means are possible, such as screw joints, for example of the type with a manhole cover with a frame, or a rubber sealing (not shown).

FIG. 2 further illustrates a preferred implementation of the sealing member 40, where it is attached to the wall 38 along a first closed circuit around the first body 34. The sealing member 40 is further attached to the first body 34 along a second closed circuit around the first body 34, wherein the ratio between the circumference of the first closed circuit and the second closed circuit is within the interval of 1.5-5, preferably within the interval of 2-4. In the embodiment illustrated in FIG. 2, both the first and the second circuits are circular, wherein the ratio between the first circuit and the second circuit is the same as the diameter D of the first circuit and the diameter d of the second circuit. The just mentioned ratio is approximately 3 in the embodiment illustrated in FIG. 2, i.e. the circumference of the first circuit is three times larger than the circumference of the second circuit.

Figure 3:
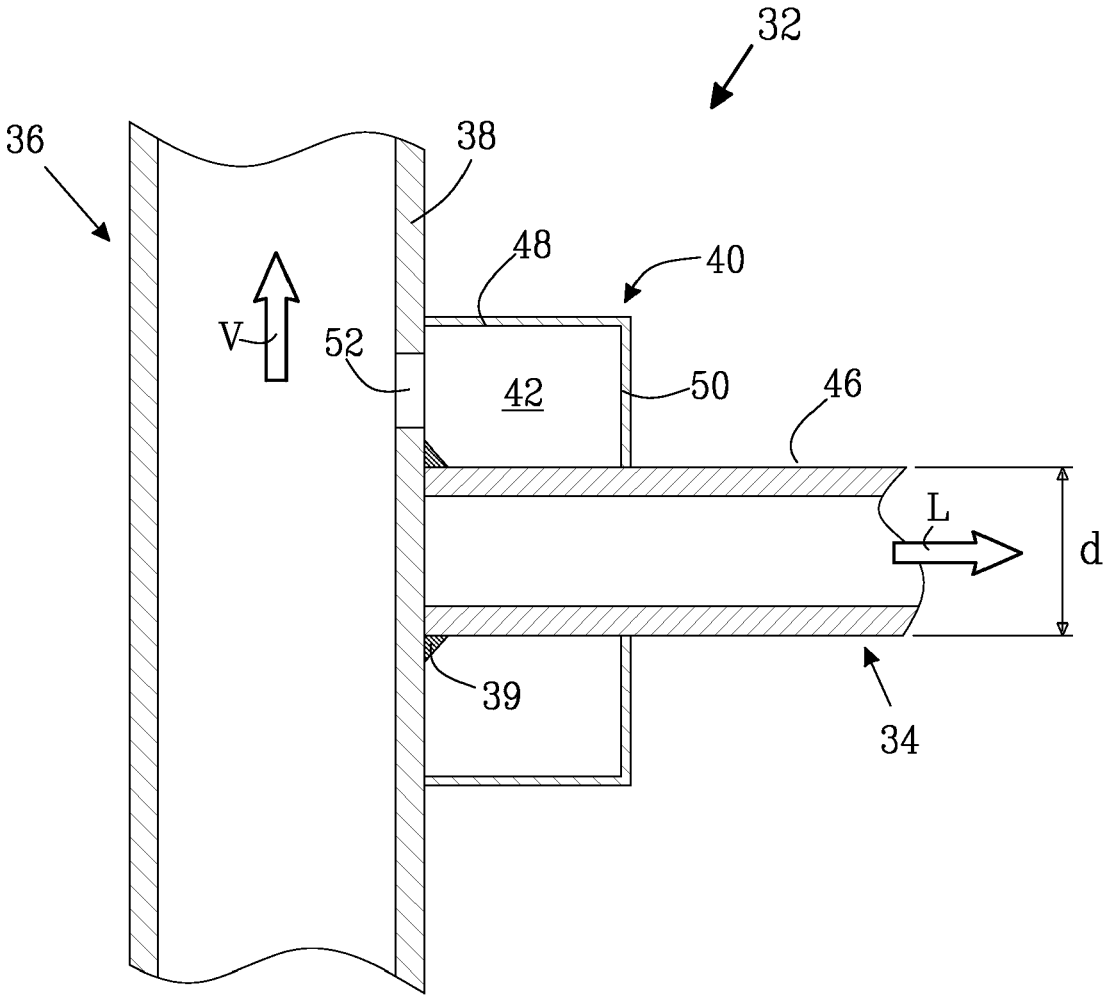
FIG. 3 depicts a cross-section of a further embodiment of the attachment.

FIG. 3 illustrates a further embodiment of the attachment 32 of the present invention, wherein the sealing member 40 comprises a first portion 48 extending substantially parallel to the extension direction L of the first body 34 and a second portion 50 extending substantially parallel to the extension direction V of the wall 38.

It is further realized from FIG. 3 that the sealing member 40 has a first extension from the wall 38 in a direction which is substantially parallel to the extension direction L of the first body 34, wherein the ratio between the length H of the first extension of the sealing member 40 and the circumference of the second circuit, which circumference in FIG. 3 is the same as the circumference of a circle with the diameter d of the first body 34, is within the interval of 0.1-1, preferably within the interval 0.2-0.6.

In the embodiment illustrated in FIG. 3, the wall 38 comprises an opening 52 which is located within the sealing member 40, in order to enable inspection of the enclosed volume 42, and in particular inspection of the weld joint 39. This opening 52 may preferably be provided with a sealing, preferably a manhole cover (not shown), in order to ensure a tight seal of the opening except for when an inspection of the enclosed volume 42 is performed.

Figure 4A:
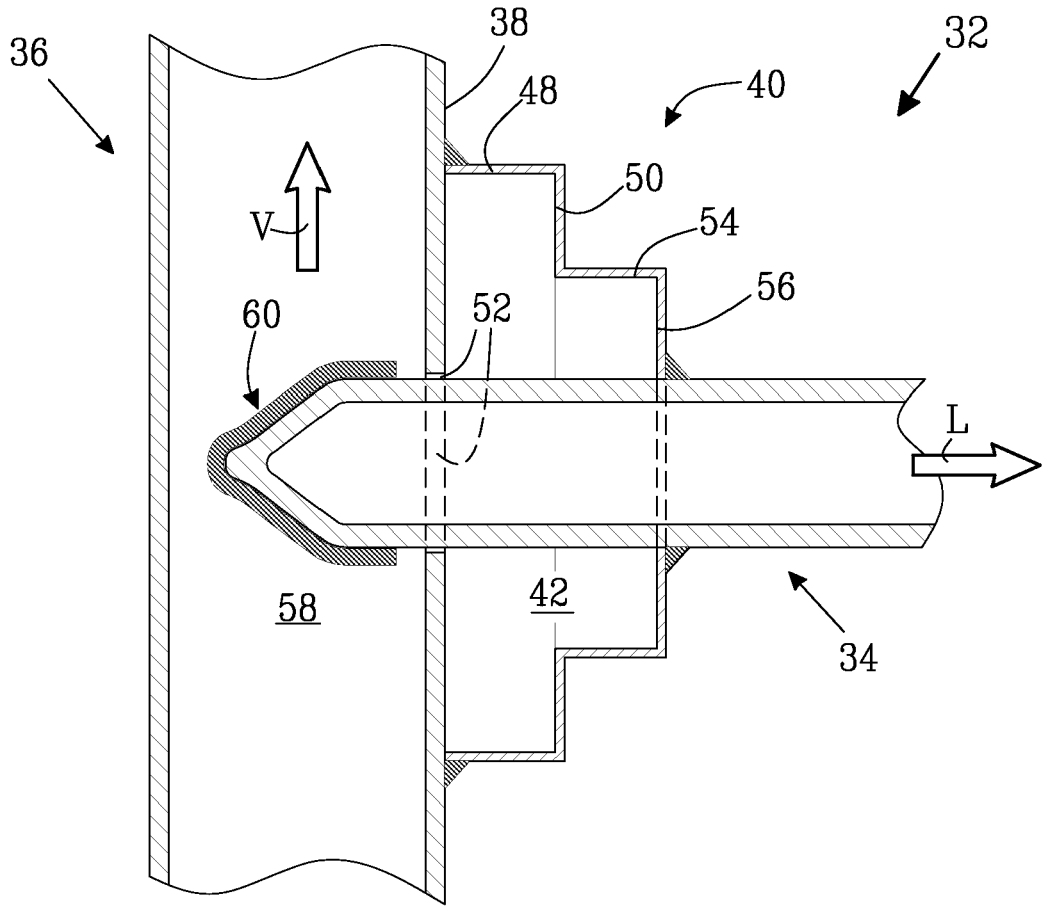
FIG. 4*a* depicts a side view of a cross-section of yet another embodiment of the attachment.

FIG. 4*a* illustrates a further embodiment of the present invention, wherein the sealing member 40 further comprises a third portion 54 extending substantially parallel to the first portion 48 and a fourth portion 56, extending substantially parallel to the second portion 50.

FIG. 4*a* further illustrates a preferred implementation of the joint between the first 34 and second 36 bodies, wherein the second body 36 comprises an inner structure 58 which is enclosed by the wall 38, wherein the first body 34 is fixedly attached to the inner structure 58 and extends out of the opening 52 in the wall 38. The inner structure 58 illustrated in FIG. 4 preferably comprises a bulkhead and preferably the first body 34 is fixedly attached to the bulkhead. In the FIG. 4 embodiment the first body 34 is fixedly attached to the bulkhead by means of a weld joint 60 which at least partially extends in the extension direction L of the first body 34. By this implementation of the weld joint 60, the loads that are transferred between the first body 34 and the second body 36 will result in loads on the weld joint 60 which are substantially parallel to the extension direction of the joint 60, which is preferred with respect to the strength of the joint 60.

Figure 4B:
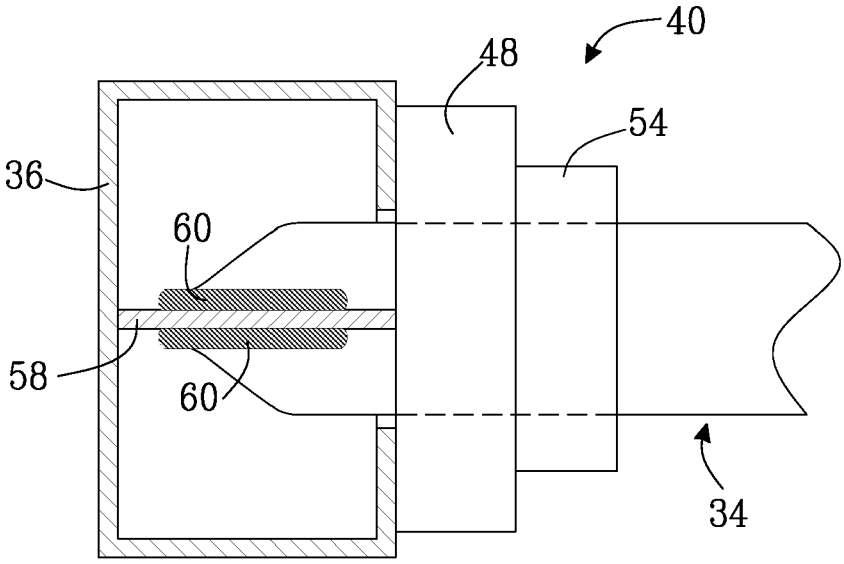
FIG. 4*b* depicts a front view of the embodiment illustrated in FIG. 4*a*.

FIG. 4*b* illustrates a top view of the embodiment illustrated in FIG. 4*a*.

Figure 5:
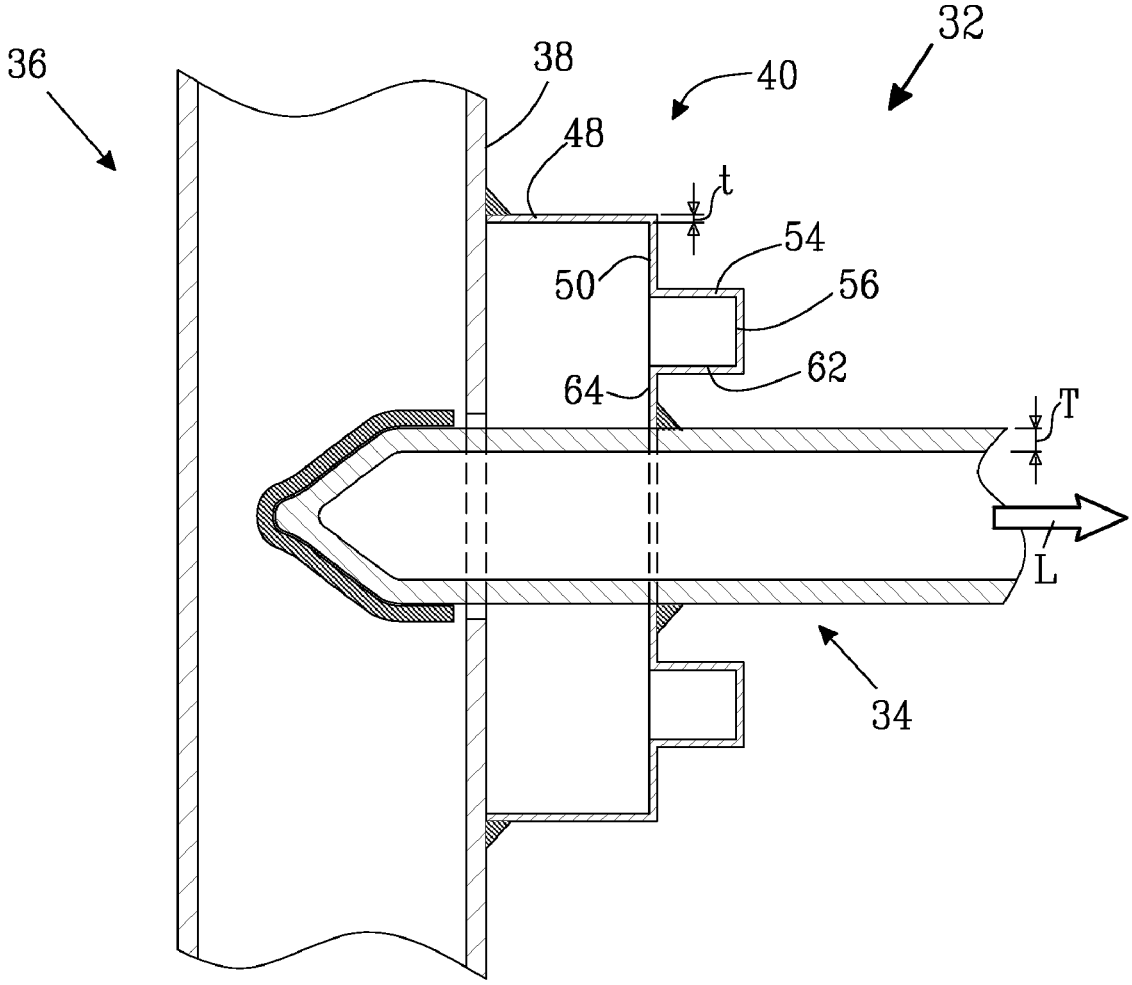
FIG. 5 depicts a cross-section of yet another embodiment of the attachment.

FIG. 5 illustrates yet another embodiment of the attachment 32 of the present invention, wherein the sealing member 40 further comprises a fifth portion 62 extending substantially parallel to the first portion 48 and a sixth portion 64 extending substantially parallel to the second portion 50, wherein the third 54 and fifth portion 62 are located at substantially the same distance from the wall. The sealing member 40 illustrated in FIG. 5 is constituted by a steel plate, wherein the steel is of the same type as the steel in the first body 34. Furthermore, it is realized from FIG. 5 that the first body has an outer wall 66 with a thickness T. Preferably, the ratio between the thickness t of the plate and the thickness T of the outer wall is within the interval of 0.1-0.6, preferably within the interval 0.2-0.4.

Figure 6:
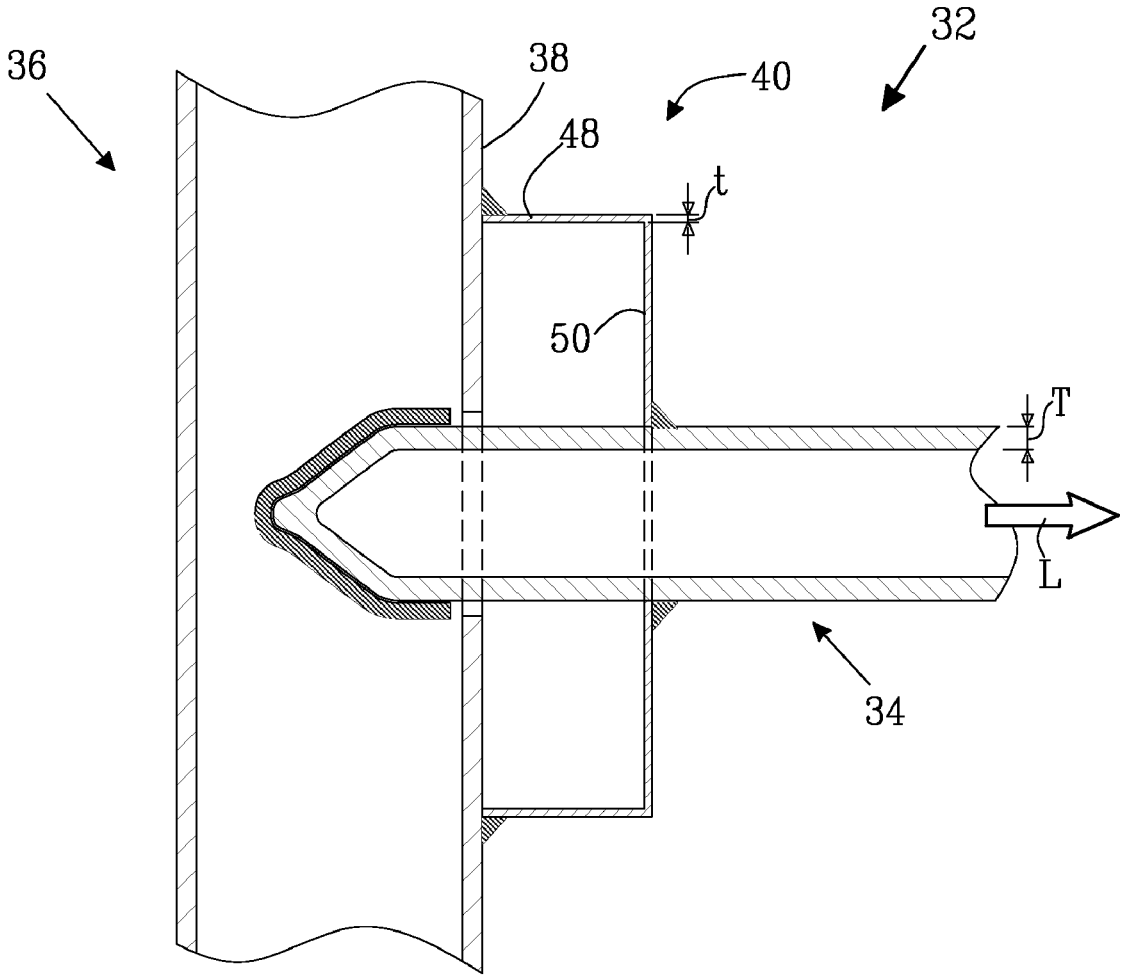
FIG. 6 depicts a cross-section of yet another embodiment of the attachment.

FIG. 6 illustrates the most preferred embodiment of the invention, in which embodiment the sealing member 40 of FIG. 3 has been combined with the attachment of the first body 34 to the second body 36 as illustrated in FIGS. 4*a* and 4*b*.

In order to obtain an attachment according to any one of the above embodiments of the attachment, a manufacturing method is preferably used which comprises the steps of: attaching the first body 34 to the second body 36 such that the first body 34 protrudes from the second body 36; applying a sealing member 40 extending between the wall 38 and the first body 34, and attaching the sealing member 40 to the wall 38 and the first body 34.

The first and second bodies 34, 36 are preferably attached to one another by means of welding. Also the sealing member 40 is attached to the wall 38 and the first body 34 by means of welding. In the cases wherein the second body 36 comprises an inner structure 58 and the wall 38 comprises an opening, the first body 34 is preferably attached to the second body 36 by attaching the first body 34 to the inner structure 58 such that the first body 34 protrudes through the opening 52.

It is realized that the present invention is not limited to the embodiments described above and illustrated in the drawings; rather a person skilled in the art will detect many alterations and modifications that can be performed within the frame of the scope of protection of the appended claims. For instance, even though the first bodies 34 in the above embodiments have been bracings, it is possible that the first body 34 may be a pontoon which is attached to a column. Furthermore, even though a semi-submersible ship is used as an example for the attachment of the invention, the marine structure in which the attachment is used could for example be a fixed installation, for instance of a jacket type, a ship or a spar buoy.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An attachment for attaching together comprising a first body and a second buoyant body of a marine structure, which marine structure is adapted to be located at least partially immersed in water, wherein at least a portion of each one of said first and second bodies is adapted to, during use, be in contact with said water, wherein said attachment comprises at least a portion of said second body, wherein said second body comprises a wall which delimits said second body, wherein said attachment further comprises at least a portion of said first body, wherein said first body is fixedly attached to, and extends from, said second body wherein said attachment further comprises a sealing member, attached to said wall and said first body, which sealing member extends from said wall to said first body such that an enclosed volume is formed between said sealing member, said first body and said second body, wherein said wall comprises an opening which is located in said portion of said second body, wherein said opening is located within said sealing member, wherein said second body comprises an inner structure which is enclosed by said wall, wherein said first body is fixedly attached to said inner structure and extends out of said opening in said wall.

2. The attachment according to claim 1, wherein said sealing member is designed such that a displacement imparted on said first body relative to said second body results in a highest mechanical stress in said sealing member which is substantially lower than a highest mechanical stress in said first body, such that only a small part of loads which are transferred between said first body and said second body is conducted through said sealing member.

3. The attachment according to claim 2, wherein said highest mechanical stress in said sealing member is less than half, preferably less than a fourth, more preferably less than a tenth of said highest mechanical stress in said first body.

4. The attachment according to claim 1, wherein said sealing member is fixedly attached to said wall and said first body by means of welded joints.

5. The attachment according to claim 1, wherein said first body is a bracing.

6. The attachment according to claim 1, wherein said sealing member is fixedly attached to said wall along a first closed circuit around said first body, wherein said sealing member further is attached to said first body along a second closed circuit around said first body, wherein the ratio between the circumference of said first closed circuit and said second closed circuit is in the interval of 1.5-5, preferably within the interval of 2-4.

7. The attachment according to claim 1, wherein said sealing member has a first extension from said wall in a direction (L) which is substantially parallel to the extension direction of said first body, wherein the ratio between the length (H) of the first extension of said sealing member and the circumference of said second circuit is within the interval of 0.1-1, preferably within the interval 0.2-0.6.

8. The attachment according to claim 7, wherein said sealing member comprises a first portion extending substantially parallel to the direction (L) of said first body and a second portion extending substantially parallel to the extension direction (V) of said wall.

9. The attachment according to claim 8, wherein said sealing member further comprises a third portion extending substantially parallel to said first portion and a fourth portion, extending substantially parallel to said second portion.

10. The attachment according to claim 9, wherein said sealing member further comprises a fifth portion extending substantially parallel to said first portion and a sixth portion extending substantially parallel to said second portion, wherein said third and fifth portion are located at substantially the same distance from said wall.

11. The attachment according to claim 1, wherein said inner structure comprises a bulkhead and said first body is fixedly attached to said bulkhead.

12. The attachment according to claim 1, wherein said sealing member is constituted by a plate, preferably a plate of the same material as said second body and/or said first body.

13. The attachment according to claim 12, wherein said first body comprises an outer wall and wherein the ratio between the thickness (t) of said plate and the thickness (T) of said outer wall is within the interval of 0.1-0.6, preferably within the interval 0.2-0.4.

14. A method of attaching together a first body and a second body of a marine structure, wherein said second body is buoyant and comprises a wall which delimits said second body, wherein said second body comprises an inner structure which is enclosed by said wall, wherein said wall further comprises an opening, wherein the method comprises the steps of:

attaching said first body to said second body by attaching said first body to said inner structure such that said first body protrudes through said opening, wherein said first body protrudes from said second body;

applying a sealing member extending between said wall and said first body, and attaching said sealing member to said wall and said first body.

15. The method according to claim 14, wherein said sealing member is attached to said wall and said first body by means of welding.

* * * * *